US012161175B2

(12) United States Patent
Coffman

(10) Patent No.: US 12,161,175 B2
(45) Date of Patent: Dec. 10, 2024

(54) HOCKEY SHIRT WITH NECK AND WRIST GUARDS

(71) Applicant: Debra Coffman, Kingston, IL (US)

(72) Inventor: Debra Coffman, Kingston, IL (US)

( * ) Notice: Subject to any disclaimer, the term of this patent is extended or adjusted under 35 U.S.C. 154(b) by 0 days.

(21) Appl. No.: 18/622,065

(22) Filed: Mar. 29, 2024

(65) Prior Publication Data

US 2024/0349823 A1 Oct. 24, 2024

Related U.S. Application Data

(60) Provisional application No. 63/461,417, filed on Apr. 24, 2023.

(51) Int. Cl.

| | |
|---|---|
| ***A41D 13/08*** | (2006.01) |
| ***A41D 1/04*** | (2006.01) |
| ***A41D 13/05*** | (2006.01) |

(52) U.S. Cl.

CPC ..... *A41D 1/04* (2013.01); *A41D 13/0512* (2013.01); *A41D 13/0562* (2013.01); *A41D 13/088* (2013.01)

(58) Field of Classification Search

CPC ... A41D 13/0512; A41D 13/088; A41D 13/08
See application file for complete search history.

(56) References Cited

U.S. PATENT DOCUMENTS

| | | | | |
|---|---|---|---|---|
| 3,945,042 | A * | 3/1976 | Lobo | A41D 13/0581 2/467 |
| 4,195,362 | A * | 4/1980 | Rolando | A41D 3/00 2/2.5 |
| 4,507,801 | A * | 4/1985 | Kavanagh | A41D 13/015 2/267 |
| 6,038,701 | A | 3/2000 | Regan | |
| 6,782,559 | B2 | 8/2004 | Regan | |
| 8,418,262 | B2 | 4/2013 | Angus | |
| 2006/0053526 | A1* | 3/2006 | Beland | A41D 13/0015 2/115 |
| 2006/0162043 | A1* | 7/2006 | Angus | A41D 13/0518 2/113 |
| 2013/0232654 | A1 | 9/2013 | Camillo | |
| 2016/0174616 | A1 | 6/2016 | Eagles et al. | |

* cited by examiner

*Primary Examiner* — Tajash D Patel
(74) *Attorney, Agent, or Firm* — Boudwin Intellectual Property Law; Daniel Boudwin

(57) ABSTRACT

A hockey shirt with neck and wrist guards having reinforced, slash-resistant neck and wrist portions to protect a hockey player from being cut from a blade of an ice hockey skate on their neck or wrist. The hockey shirt includes a garment body having a pair of sleeves, an upper head opening, and a lower torso opening. The upper head opening further comprises a first reinforcement guard about a perimeter of the upper head opening. The first reinforcement guard is integral with the garment body and provides increased cut resistance. A distal end of each sleeve of the pair of sleeves includes a second reinforcement guard about a circumference of each distal end of each of the pair of sleeves. The reinforcement guards are integral with the garment body and provide increased cut resistance. Each of the reinforcement guards are made of para-aramid (p-aramid) fibers or KEVLAR®.

14 Claims, 3 Drawing Sheets

HOCKEY SHIRT WITH NECK AND WRIST GUARDS

CROSS-REFERENCE TO RELATED APPLICATIONS

This is a U.S. Non-Provisional Patent Application that claims the benefit of U.S. Provisional Patent Application No. 63/461,417 filed Apr. 24, 2023, which is incorporated herein by reference in its entirety.

BACKGROUND OF THE INVENTION

The present invention relates to an athletic shirt. More particularly, the present invention relates to a hockey undershirt with neck and wrist guards.

Many people enjoy playing ice hockey. Due to the level of risk for injury while playing the sport, players are required to wear protective gear to help keep them warm while on the ice, as well as to help keep them safe and free from injuries. The most serious risk of injury is the potential for a player to be cut from a blade of an ice hockey skate on their neck or wrist.

There are currently protective athletic shirts containing para-aramid (p-aramid) fibers or KEVLAR® neck guards that are available on the market. KEVLAR® wrist guards are also currently available on the market. However, both of these protective garments need to be purchased separately. The separate wrist guards are also relatively easily misplaced putting an ice hockey player at risk of injury needing to play without them.

Therefore, there is a defined need amongst the known prior art for a hockey shirt with neck and wrist guards having both reinforced, slash-resistant neck and wrist portions to protect a hockey player from being cut from a blade of an ice hockey skate on their neck or wrist.

In light of the hockey shirts with neck and wrist guards disclosed in the known prior art, it is submitted that the present invention substantially diverges in functional and design elements from the known art and consequently it is clear that there is a need in the art for an improvement to existing hockey shirts with neck and wrist guards. In this regard the present invention substantially fulfills these needs.

SUMMARY OF THE INVENTION

In view of the foregoing disadvantages inherent in the types of hockey shirts with neck and wrist guards and similar devices now present in the known prior art, the present invention provides a hockey shirt with neck and wrist guards that may protect a hockey player from being cut from a blade of an ice hockey skate on their neck or wrist.

The present invention relates to an athletic shirt. More particularly, the present invention relates to a hockey undershirt with neck and wrist guards.

One embodiment of the hockey shirt with neck and wrist guards comprises a garment body including a pair of sleeves, an upper head opening, and a lower torso opening and a plurality of guards including a first reinforcement guard and a pair of second reinforcement guards.

Another embodiment of the hockey shirt with neck and wrist guards comprises a garment body including a pair of sleeves, an upper head opening, and a lower torso opening, the garment body is a sports undergarment that is adapted to be worn underneath a plurality of hockey equipment and a hockey jersey of a hockey player and a plurality of guards including a first reinforcement guard and a pair of second reinforcement guards, the first reinforcement guard is adapted to protect a hockey player's neck, and the pair of second reinforcement guards are adapted to protect each of a hockey player's wrists.

Another object of the present invention is to provide a hockey shirt with neck and wrist guards that includes a garment body having a pair of sleeves, an upper head opening, and a lower torso opening.

One object of the present invention is to provide a hockey shirt with neck and wrist guards that includes a first reinforcement guard disposed about a perimeter of an upper head opening.

One object of the present invention is to provide a hockey shirt with neck and wrist guards that includes a second reinforcement guard disposed about a circumference of each distal end of each of a pair of sleeves of the hockey shirt with neck and wrist guards.

One object of the present invention is to provide a hockey shirt with neck and wrist guards that includes reinforcement guards that are integral with the garment body and provides increased cut resistance.

One object of the present invention is to provide a hockey shirt with neck and wrist guards that includes each reinforcement guard is made of para-aramid (p-aramid) fibers or KEVLAR®.

One object of the present invention is to provide a hockey shirt with neck and wrist guards that includes a hook and loop or VELCRO® fastener to secure the first reinforcement guard to the hockey player.

Other objects, features, and advantages of the present invention will become apparent from the following description taken in conjunction with the accompanying figures.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
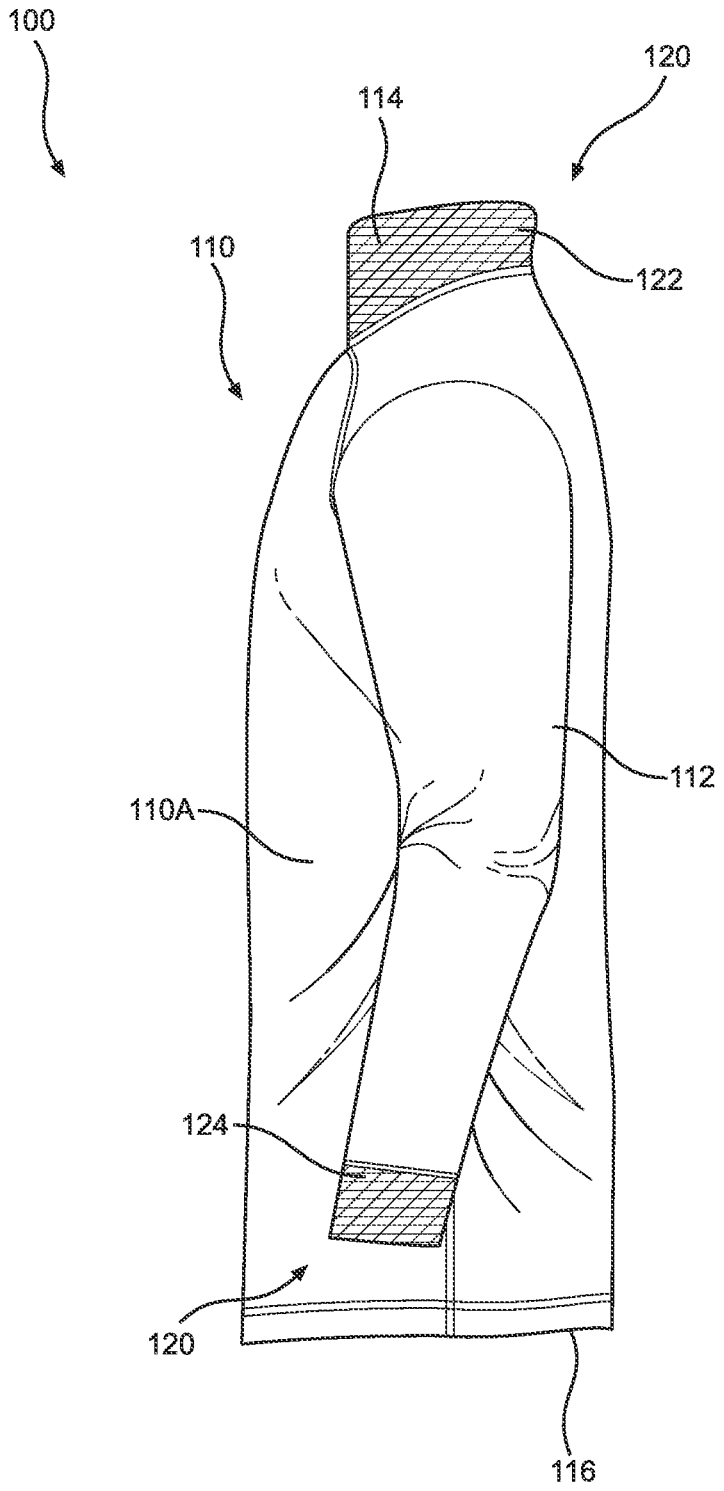
FIG. 1 shows a side view of an embodiment of a hockey shirt with neck and wrist guards.

Reference is made herein to the attached figures. For the purposes of presenting a brief and clear description of the present invention, the preferred embodiment will be discussed as used for providing a hockey shirt with neck and wrist guards. The figures are intended for representative purposes only and should not be considered to be limiting in any respect.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Figure 2:
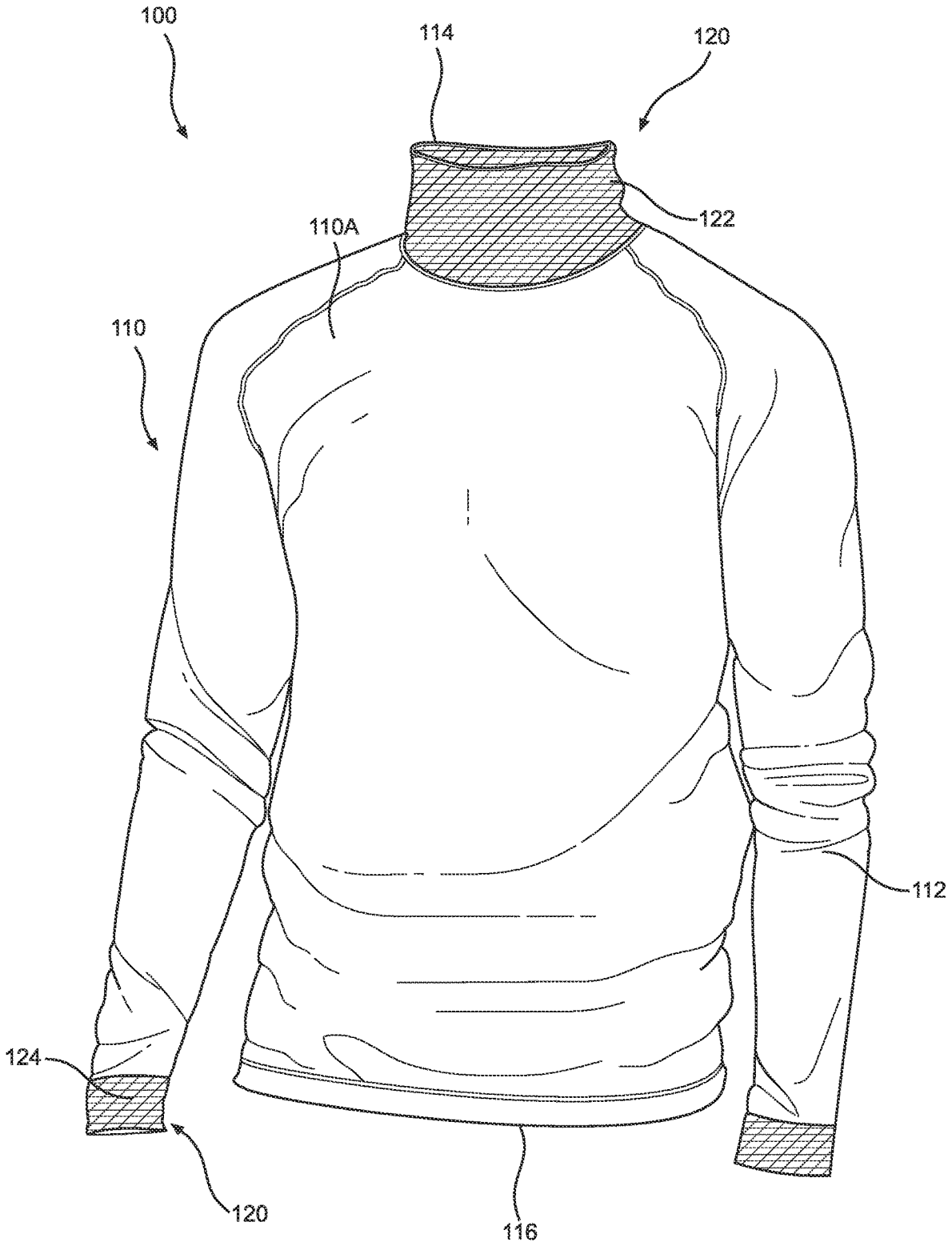
FIG. 2 shows a perspective view of an embodiment of a hockey shirt with neck and wrist guards.

Referring now to FIG. 2, there is shown a perspective view of an embodiment of a hockey shirt with neck and wrist guards 100.

The hockey shirt with neck and wrist guards 100 may include a garment body 110 and a plurality of guards 120.

The garment body 110 may include a pair of sleeves 112, an upper head opening 114, and a lower torso opening 116. The garment body 110 may be a sports undergarment 110A that is adapted to be worn underneath a plurality of hockey equipment and a hockey jersey of a hockey player or the like (all not shown). The hockey equipment may include a neck guard, a pair of hockey shoulder pads, and a pair of elbow pads or the like (all not shown). The garment body 110 may be worn in place of a traditional hockey undergarment or the like (not shown). The garment body 110 may be made of moisture wicking and breathable material or the like.

The guards 120 may include a first reinforcement guard 122 and a pair of second reinforcement guards 124. The first reinforcement guard 122 may protect a hockey player's neck and the pair of second reinforcement guards 124 may protect each of a hockey player's wrists from getting severely cut from a hockey player's skate or other injury source such as a hockey puck, hockey stick or the like.

Figure 3:
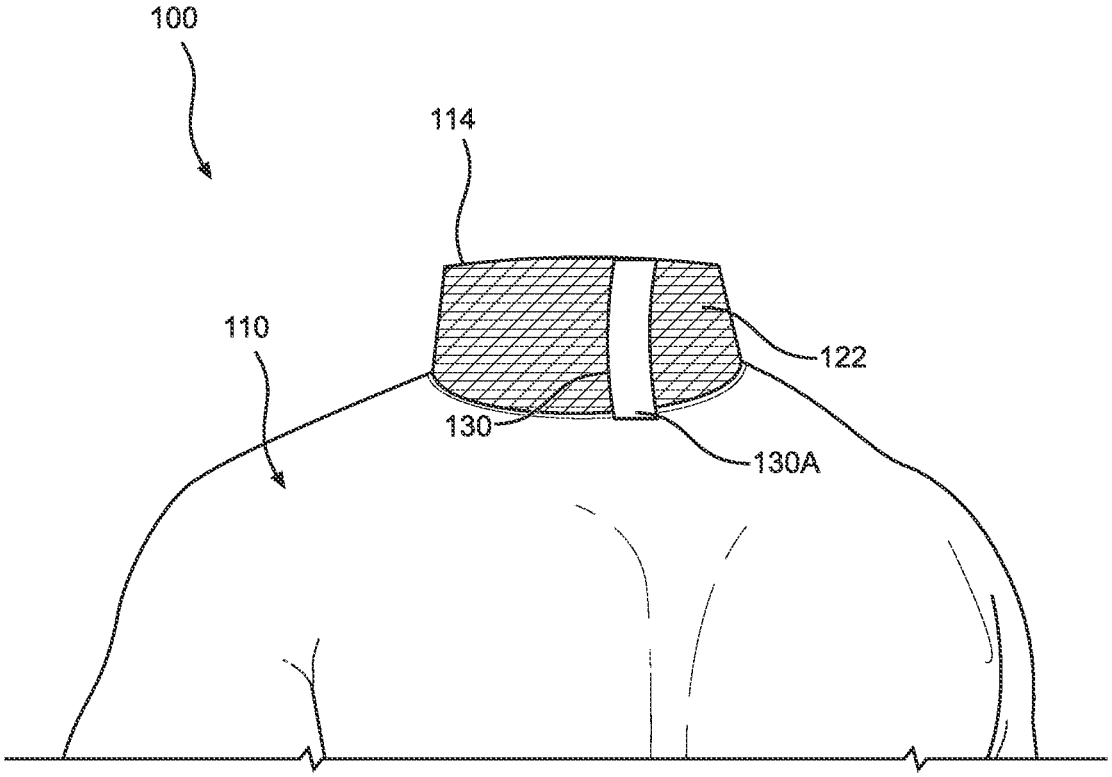
FIG. 3 shows a perspective view of an embodiment of an upper head opening of a hockey shirt with neck and wrist guards.

Referring now to FIG. 3, there is shown a perspective view of an embodiment of the upper head opening 114 of the hockey shirt with neck and wrist guards 100.

The upper head opening 114 may further comprise the first reinforcement guard 122 about a perimeter of the upper head opening 114 and is integral with the garment body 110 and provides increased cut resistance.

The upper head opening 114 of the hockey shirt with neck and wrist guards 100 may also include a fastener 130 such as a hook and loop fastener or VELCRO® fastener 130A that may be disposed on the rear portion of the upper head opening 114 to ensure the first reinforcement guard 122 is secured snugly around a hockey player's neck.

Referring now to FIGS. 1 and 2, there are shown a side view and a perspective view of an embodiment of a hockey shirt with neck and wrist guards 100.

The first reinforcement guard 122 may be integrated into the upper head opening 114 of the garment body 110. The pair of second reinforcement guards 124 may be integrated into a circumference of each distal end of each of a pair of sleeves 112 of the garment body 110 of the hockey shirt with neck and wrist guards 100. The first reinforcement guard 122 and the pair of second reinforcement guards 124 may be made of para-aramid (p-aramid) fibers or KEVLAR®.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hockey shirt with neck and wrist guards, comprising:

a garment body including a pair of sleeves, an upper head opening, and a lower torso opening; and a plurality of guards including a first reinforcement guard and a pair of second reinforcement guards;

wherein the first reinforcement guard is adapted to protect a hockey player's neck from getting severely cut from a hockey player's skate or other injury source;

wherein the pair of second reinforcement guards are adapted to protect each of a hockey player's wrists from getting severely cut from the hockey player's skate or other injury source;

wherein the first reinforcement guard and the pair of second reinforcement guards are made of para-aramid (p-aramid) fibers; and wherein the pair of second reinforcement guards is integrated into a circumference of each distal end of each of a pair of sleeves of the garment body of the hockey shirt with neck and wrist guards.

2. The hockey shirt with neck and wrist guards, according to claim 1, wherein the garment body is a sports undergarment that is adapted to be worn underneath a plurality of hockey equipment and a hockey jersey of a hockey player.

3. The hockey shirt with neck and wrist guards, according to claim 1, wherein the upper head opening includes the first reinforcement guard about a perimeter of the upper head opening that is integral with the garment body and provides increased cut resistance.

4. The hockey shirt with neck and wrist guards, according to claim 3, wherein the upper head opening of the hockey shirt with neck and wrist guards includes a fastener that is disposed on the rear portion of the upper head opening to ensure the first reinforcement guard is secured snugly around the hockey player's neck.

5. The hockey shirt with neck and wrist guards, according to claim 4, wherein the fastener is a hook and loop fastener.

6. A hockey shirt with neck and wrist guards, comprising:

a garment body including a pair of sleeves, an upper head opening, and a lower torso opening, the garment body is a sports undergarment that is adapted to be worn underneath a plurality of hockey equipment and a hockey jersey of a hockey player; and a plurality of guards including a first reinforcement guard and a pair of second reinforcement guards, the first reinforcement guard is adapted to protect a hockey player's neck, and the pair of second reinforcement guards are adapted to protect each of a hockey player's wrists;

wherein the first reinforcement guard is adapted to protect a hockey player's neck from getting severely cut from a hockey player's skate or other injury source;

wherein the pair of second reinforcement guards are adapted to protect each of a hockey player's wrists from getting severely cut from the hockey player's skate or other injury source;

wherein the first reinforcement guard and the pair of second reinforcement guards are made of para-aramid (p-aramid) fibers; and wherein the pair of second reinforcement guards is integrated into a circumference of each distal end of each of a pair of sleeves of the garment body of the hockey shirt with neck and wrist guards.

7. The hockey shirt with neck and wrist guards, according to claim 6, wherein the garment body is a sports undergarment that is adapted to be worn underneath a plurality of hockey equipment and a hockey jersey of a hockey player.

8. The hockey shirt with neck and wrist guards, according to claim 7, wherein the hockey equipment includes a neck guard, a pair of hockey shoulder pads, and a pair of elbow pads.

9. The hockey shirt with neck and wrist guards, according to claim 6, wherein the garment body is worn in place of a traditional hockey undergarment.

10. The hockey shirt with neck and wrist guards, according to claim 6, wherein the garment body is made of moisture wicking and breathable material.

11. The hockey shirt with neck and wrist guards, according to claim 6, wherein the upper head opening includes the first reinforcement guard about a perimeter of the upper head opening that is integral with the garment body and provides increased cut resistance.

12. The hockey shirt with neck and wrist guards, according to claim 11, wherein the upper head opening of the hockey shirt with neck and wrist guards includes a fastener that is disposed on the rear portion of the upper head opening to ensure the first reinforcement guard is secured snugly around the hockey player's neck.

13. The hockey shirt with neck and wrist guards, according to claim 12, wherein the fastener is a hook and loop fastener.

14. The hockey shirt with neck and wrist guards, according to claim 6, wherein the first reinforcement guard is integrated into the upper head opening of the garment body.

* * * * *